United States Patent [19]

Bierwith

[11] Patent Number: 5,052,134

[45] Date of Patent: Oct. 1, 1991

[54] TOOTH MOUNTING APPARATUS FOR EXCAVATION BUCKET

[76] Inventor: Robert S. Bierwith, 145 Basinside St., Alameda, Calif. 94501

[21] Appl. No.: 576,635

[22] Filed: Aug. 31, 1990

Related U.S. Application Data

[63] Continuation-in-part of Ser. No. 427,145, Oct. 25, 1989, abandoned.

[51] Int. Cl.[5] ..... E02F 3/76

[52] U.S. Cl. ..... 37/142 A; 37/141 T; 37/141 R; 299/91; 299/92

[58] Field of Search ..... 37/141 R, 141 T, 142 R, 37/142 A; 299/91, 92

[56] References Cited

U.S. PATENT DOCUMENTS

| | | | |
|---|---|---|---|
| 3,685,177 | 8/1972 | Hahn et al. | 37/141 R |
| 3,947,982 | 4/1976 | Mantovani | 299/91 X |
| 4,127,952 | 12/1978 | Chamberlain | 37/141 R |
| 4,282,665 | 8/1981 | Fletcher et al. | 299/92 X |
| 4,501,079 | 2/1985 | Hahn et al. | 37/141 R |
| 4,579,494 | 4/1986 | Bierwith | 37/142 A |

*Primary Examiner*—Dennis L. Taylor
*Assistant Examiner*—J. Russell McBee
*Attorney, Agent, or Firm*—Townsend and Townsend

[57] ABSTRACT

An improved adapter and lip segment for an ore excavation bucket wherein the adapter can be coupled to an excavation tooth. The adapter is streamlined to minimize the weight of the lip segment and adapter combination yet the wear on the lip is minimized to extend the life of the operation of the lip and to minimize maintenance costs of the bucket. Each lip segment has a pair of pockets on the upper and lower surfaces thereof. The pockets are adapted to receive the ends of the pair of legs on each adapter, and in one embodiment, the adapter is coupled to the corresponding lip segment by a pin which extends through aligned holes in the legs of the adapter and the lip segment. The pin can be a spring pin or a wedge-shaped pin. In another embodiment, the lip segment has a pair of spaced, aligned holes and one of the legs of the adapter is alignable with the holes of the lip segment. A wedge block and a wedge key are forced into the aligned holes. The adapter has shoulder shrouds which protect the lip segment from wear due to attrition of the ore flowing over the lip.

24 Claims, 6 Drawing Sheets

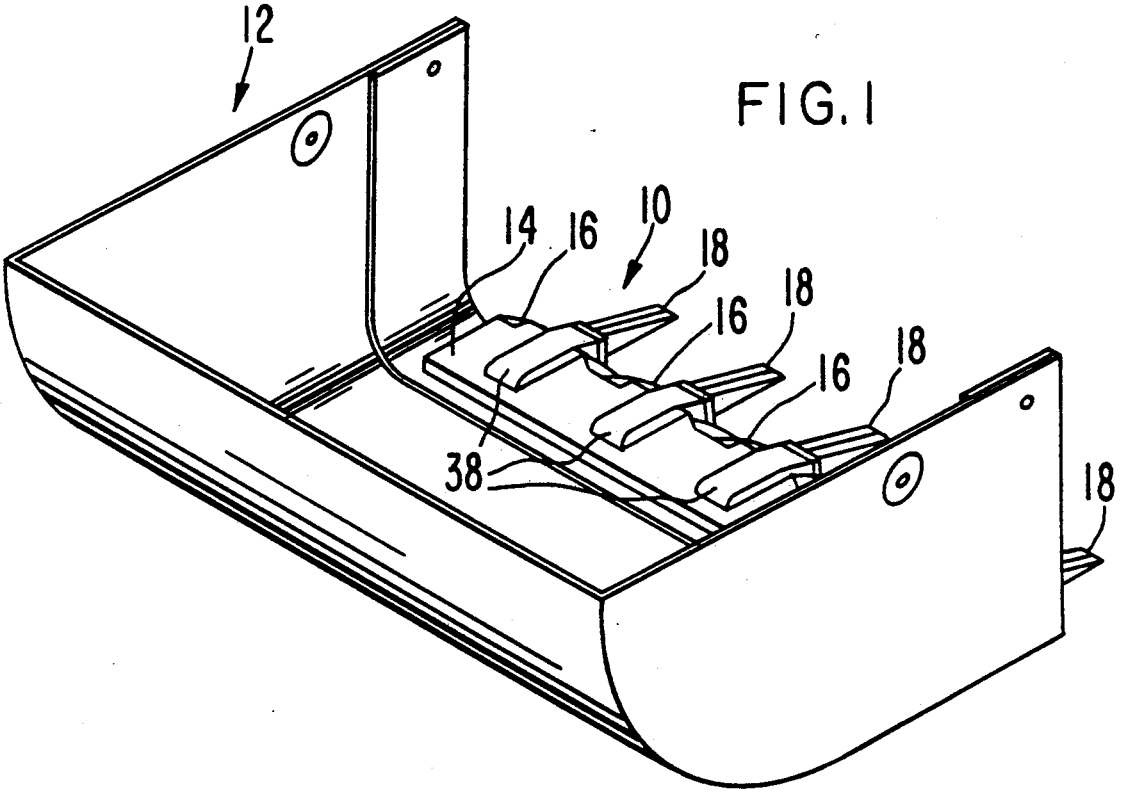
FIG. 1
FIG. 2
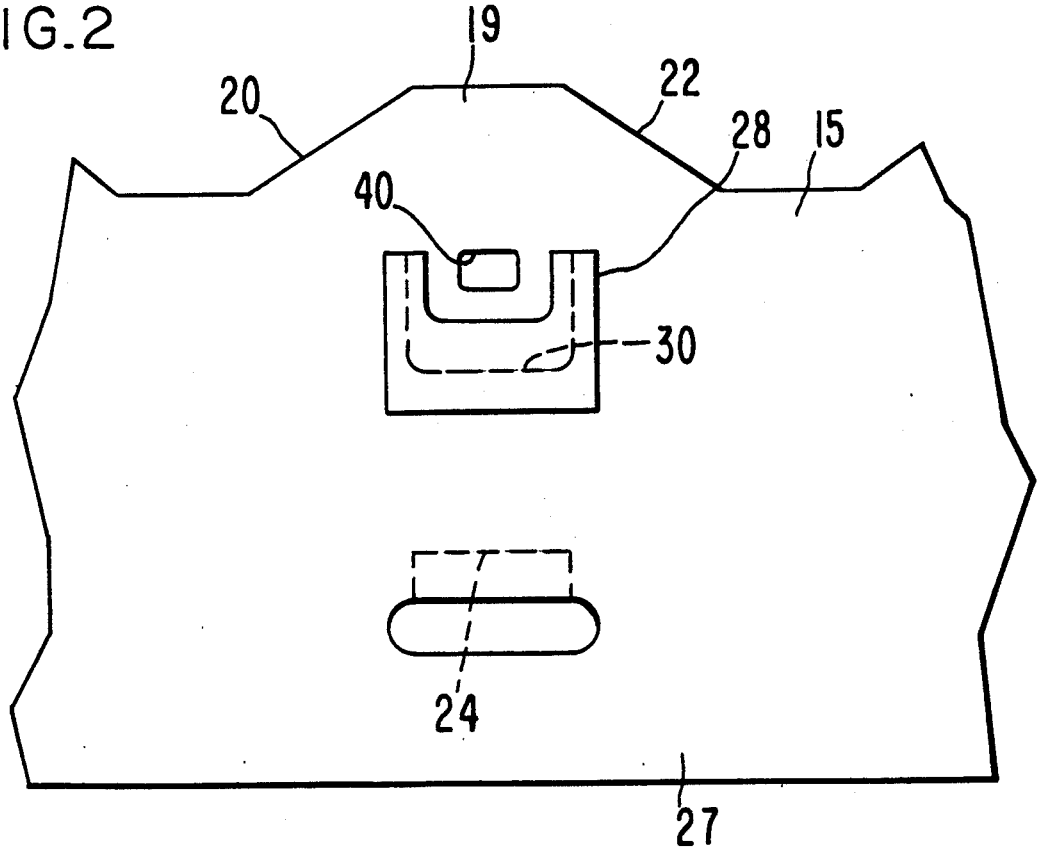

FIG.3
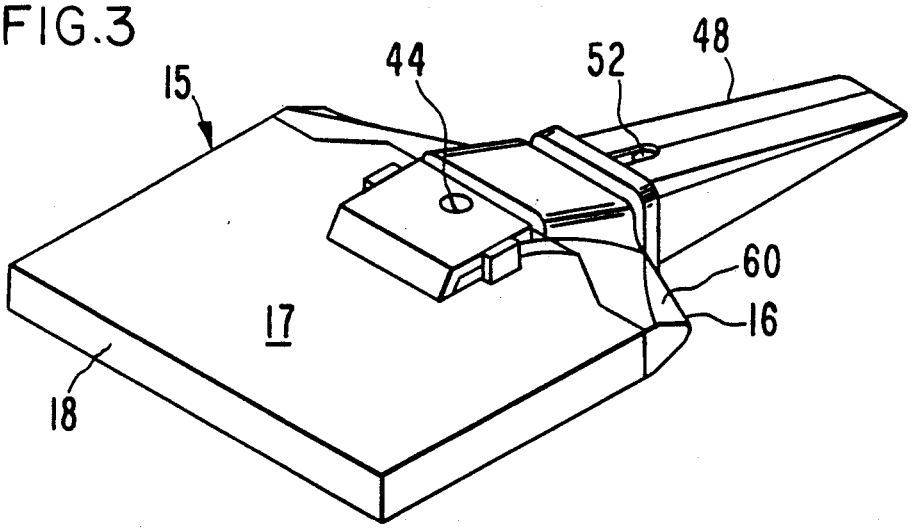
FIG.4
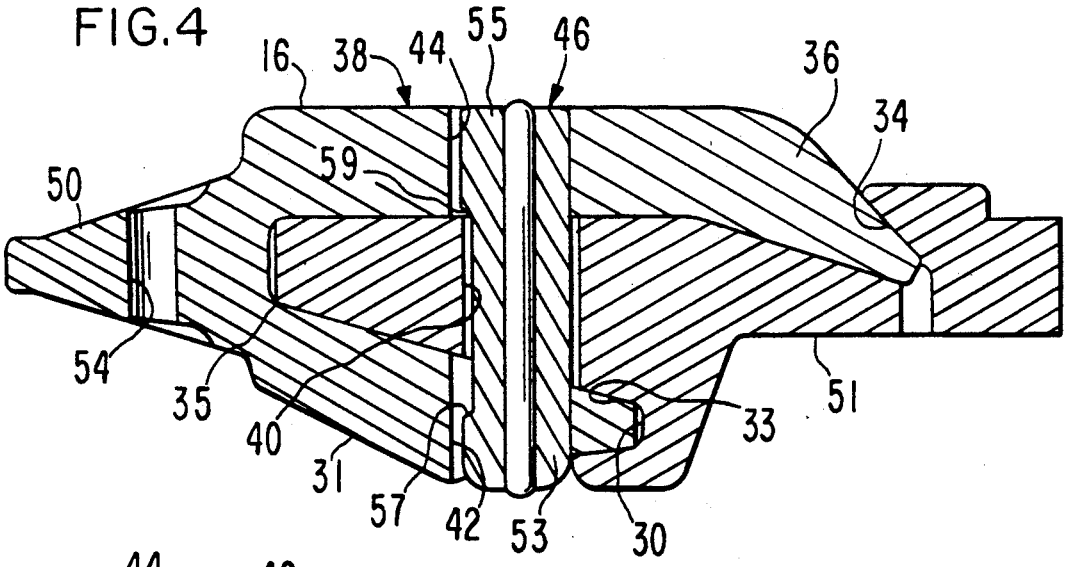
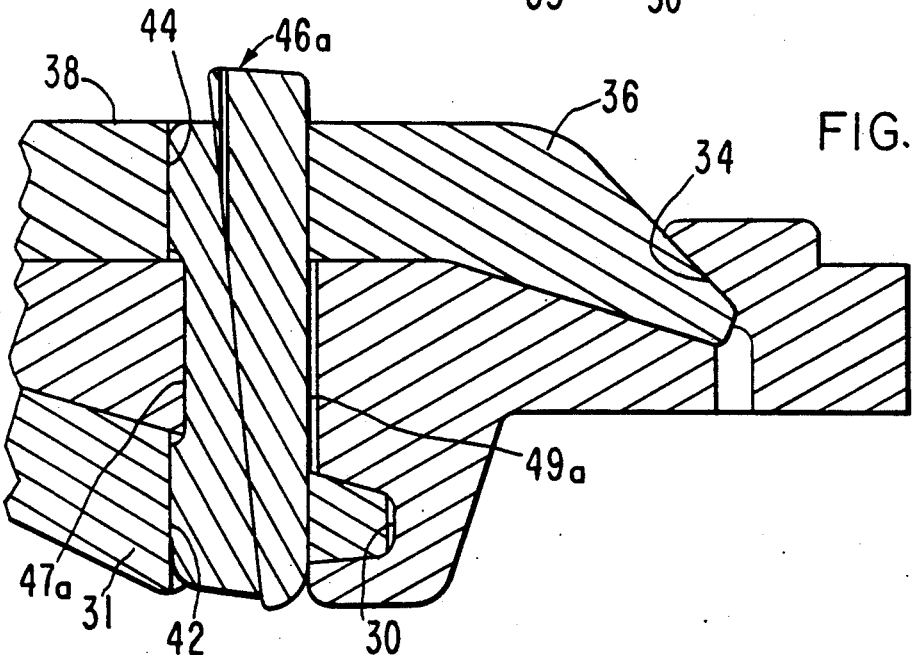
FIG.6

TOOTH MOUNTING APPARATUS FOR EXCAVATION BUCKET

This application is a continuation-in-part of U.S. Application Serial No. 07/427,145, filed Oct. 25, 1989, now abandoned entitled TOOTH MOUNTING APPARATUS FOR EXCAVATION BUCKET.

FIELD OF THE INVENTION

This invention relates to improvements in buckets of the type for excavating ore from the ground and, more particularly, to an improved apparatus for coupling excavating teeth to such a bucket.

BACKGROUND OF THE INVENTION

In a conventional ore excavating bucket, a number of excavating teeth are coupled by adapters to the lip of the bucket, and the teeth are used with the bucket for loosening the ore to be excavated from the ground. Generally, the lip, adapter and teeth structure of a conventional bucket is extremely heavy in weight and, as a result, expensive to produce and to maintain. The teeth and adapter of the bucket must often be replaced because of the heavy attrition due to the movement of the ore material over the lip, adapter and teeth due to their specific designs.

A need, therefore, exists for improvements in such lip, adapter and teeth designs to keep the weight to a minimum and to minimize the frequency at which they are replaced so as to keep the cost of excavation down without sacrificing the normal life of the bucket. The present invention is directed to satisfying this need.

SUMMARY OF THE INVENTION

The present invention is directed to an improved tooth-mounting adapter and lip for an ore excavation bucket wherein the adapter is removably coupled in a unique manner to the lip yet the adapter is streamlined to minimize the weight of the lip and adapter combination. Moreover, the lip and adapter are designed to reduce the wear on the lip to extend the life of the lip and to minimize maintenance costs for the bucket.

To this end, the lip, although of a one-piece construction, can be considered to be divided into a number of adjacent, side-by-side segments with each segment having an upper pocket and a lower pocket in the upper and lower surfaces thereof. There is an adapter for each lip segment, respectively. The pockets of each segment are adapted to receive the inner ends of a long leg and a short leg of the corresponding adapter, and the adapter, in one embodiment, is coupled to the corresponding lip segment by a pin, or wedge assembly, which extends through aligned holes in the legs of the adapter and in the lip segment itself.

In another embodiment of the adapter, the lip segment has a pair of holes aligned with a hole in the long leg of the adapter, so that a pin can extend through the long leg and the lip segment while the short leg is received in a pocket in the lower side of the lip segment. The long leg is held by the pin in a second pocket in the upper side of the lip segment.

The pocket on the upper surface of the adapter is below such upper surface to allow capture of the inner end of the upper or long leg below the upper surface of the adapter. This feature allows greater wear of the upper leg before the adapter must be replaced. The upper leg is able to enter the upper pocket and to extend below the upper surface of the lip because the inner end of the upper leg extends at an angle to the major portion of the upper leg. The lower leg extends also at an angle so as to allow the adapter to be moved easily into and out of an operative position on the lip segment.

The pin can be a spring pin or a wedge-shaped pin. Before or after the adapter is coupled to the lip segment, a tooth can be coupled by a pin to the outer end of the adapter. Shoulder shrouds at the sides of the adapter protect the outer end of the lip segment from wear due to movement of the ore flowing over the lip. This feature allows the lip and adapter to have two to four times the life of the lip and adapter of a conventional bucket yet the lip and adapter combination of the present invention is relatively light in weight to minimize production costs of the bucket.

The primary object of the present invention is to provide an improved lip and adapter for an ore excavation bucket wherein the combination of these two components is lightweight and rugged in construction and is streamlined to minimize wear and to prolong the life of the components.

Other objects of this invention will become apparent as the following specification progresses, reference being had to the accompanying drawings for an illustration of the invention.

BRIEF DESCRIPTION OF THE DRAWINGS

FIG. 1 is a perspective view of an excavating bucket for ore excavation, showing the lip of the bucket and a number of adapters coupled to the bucket for connecting excavating teeth to the lip;

FIG. 2 is a top plan view of a segment of the lip on which one of the adapters for the bucket of FIG. 1 is to be mounted;

FIG. 3 is a perspective view of a segment of the lip, showing the bottom part of the corresponding adapter and further showing an excavating tooth on the outer end of the adapter;

Figure 5:
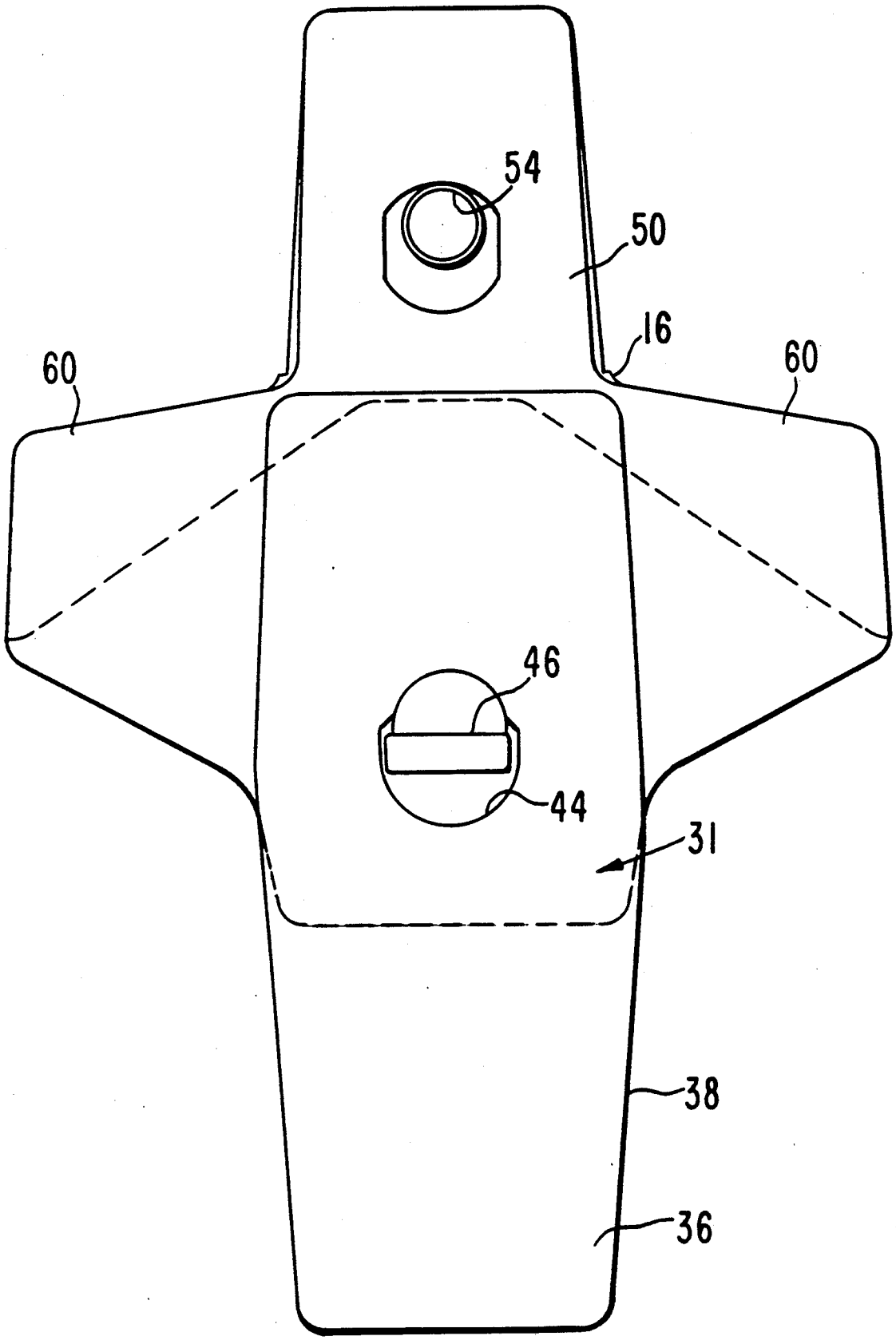
Figure 6A:
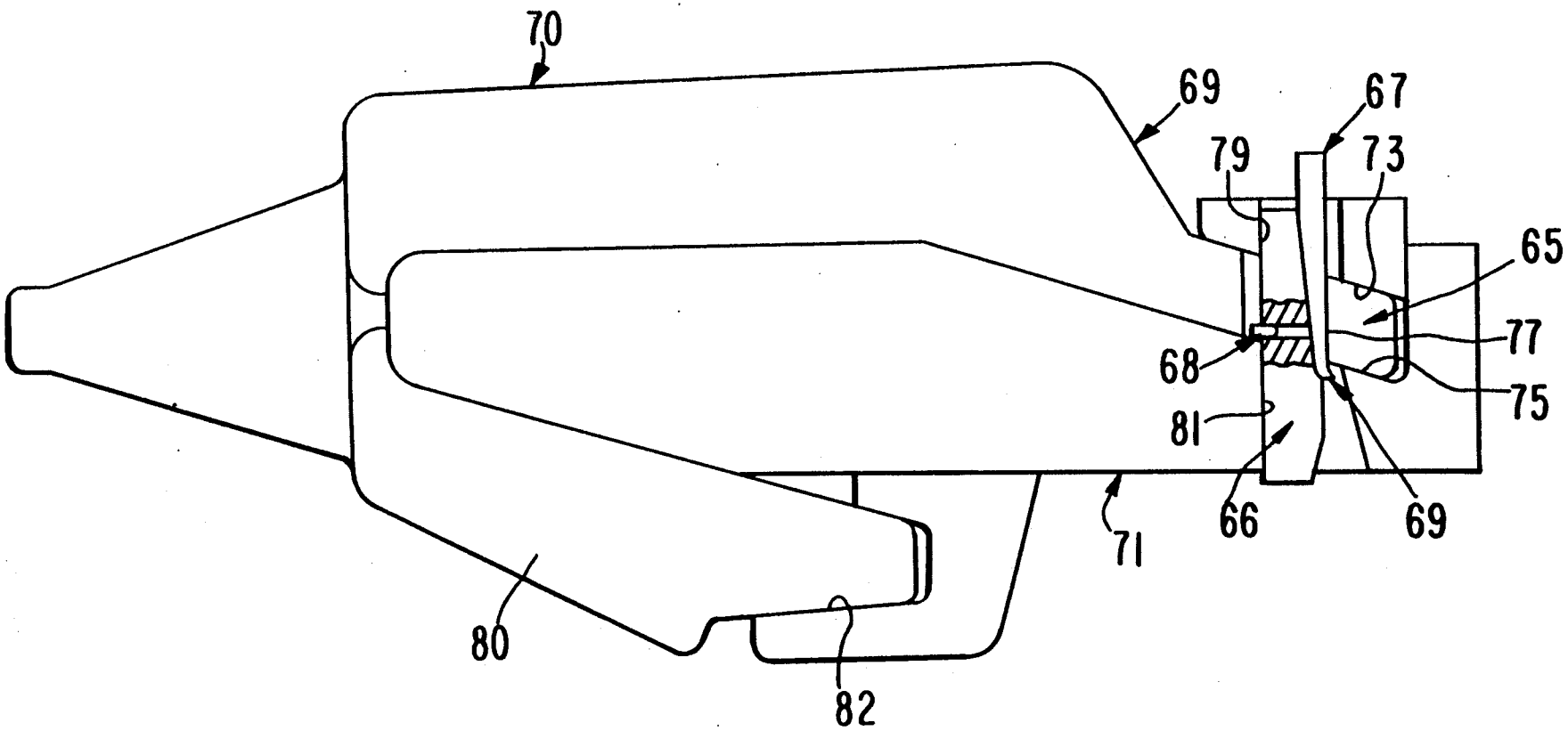
Figure 6B:
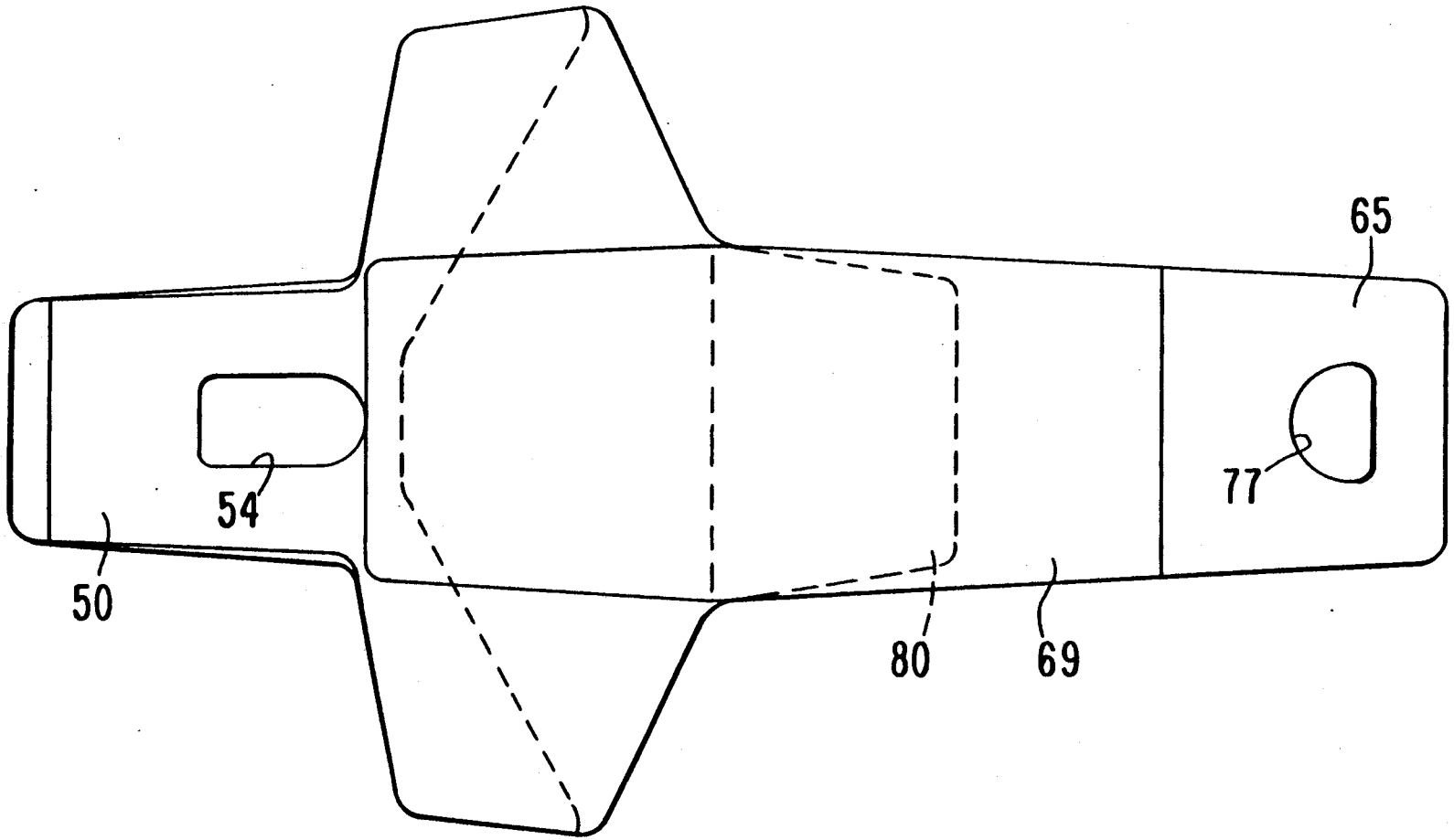

FIG. is side elevational view of the adapter of FIG. 3 locked by a spring pin to the lip segment corresponding thereto;

FIG. 5 is a top plan view of the adapter separated from the lip segment;

FIG. 6 is a view similar to FIG. 4 but showing a wedge-type pin connecting the adapter with the lip segment corresponding thereto;

FIG. 6A is a view similar to FIG. 4 but showing a wedge-type coupling means;

FIG. 6B is a view similar to FIG. 5 but showing a hole in the long or upper leg of the adapter for coupling the upper leg to the lip segment; and.

Figure 7:
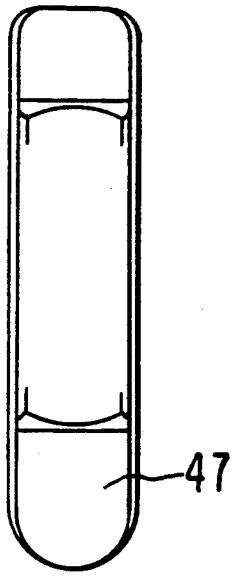
Figure 8:
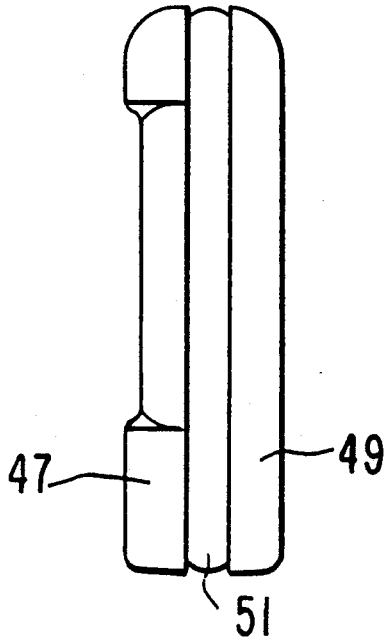
Figure 9:
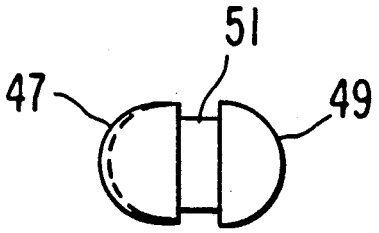

FIG. 7, 8 and 9 are plan, side and end views of a spring pin which could be used as shown in FIG. 4.

DETAILED DESCRIPTION OF THE DRAWINGS

The apparatus of the present invention is broadly denoted by the numeral 10 and is adapted to be used with an ore excavating bucket 12 of conventional construction, the ore excavating bucket 12 having an improved one-piece lip 14 to which individual adapters 16 are coupled so as to provide a means for connecting excavating teeth 18 to the lip in a unique manner. The present invention includes the combination of the adapters 16 and corresponding segments 14 of the lip 14.

Each segment 15 of the lip 14 has a configuration of the type shown in FIGS. 2 and 3. To this end, each lip segment 15 has a substantially flat lower surface 17 and a substantially flat upper surface 18. The outer end 19 of the lip segment 15 has a pair of converging surfaces 20 and 22, lower and upper surfaces 17 and 18 being separated by a certain lip thickness such as that shown in FIG. 3.

Lower surface 17 is provided with means 28 defining a first pocket 30 shown in dashed lines in FIG. 2 for receiving a lower relatively short leg 31 (FIG. 4) forming part of the corresponding adapter 16. FIG. 4 shows leg 31 in pocket 30 whereby the lower part of the adapter 16 is releasably coupled to the lip segment 15. Leg 31 extends outwardly from the adapter (FIG. 4) at an angle which typically can be in the range of 15° to 30°. The pocket 30 has an inclined surface 33 FIG. 4) which is substantially complemental to the adjacent angled surface 35 of leg 31.

Lip segment 15 as shown in FIG. 3 has means 32 defining an upper pocket 34 for receiving the angled inner end 36 of an upper, relatively long leg 38 forming part of the corresponding adapter 16. The upper pocket 34 extends below the upper surface 18 of the lip segment 15 so as to capture the inner end portion 36 of leg 38 below such upper surface. This feature allows for greater wear of the upper leg before the corresponding adapter must be replaced. The angle of the end portion 36 is typically in the range of 15° to 30° but it can be out of this range, if desired. When both legs 31 and 38 of the adapter are received in respective pockets 30 and 34, each adapter is releasably coupled to the corresponding adjacent lip segment 15.

Each lip segment 15 has a hole 40 therethrough as shown in FIGS. 2 and 4. Similarly, lower leg 31 has a hole 42 and upper leg 38 has a hole 44 therein, holes 40, 42 and 44 being aligned with each other when the inner ends of legs 31 and 38 are received within respective pockets 30 and 34 as shown in FIG. 4.

When holes 40, 42 and 44 are aligned with each other, they can receive a pin 46 which effectively locks the corresponding adapter 16 to the adjacent lip segment 15. Thus, an excavating tooth 18 (FIG. 3) on the outer projection 50 of the adapter 16 (FIG. 4) is effectively coupled to the lip segment 15 when a pin is received within a hole 52 of the tooth 18 and a hole 54 (FIG. 4) of projection 50.

One embodiment of the pin 46 is shown in FIG. 4 and in FIGS. 7, 8 and 9. Pin 46 includes a pair of semicylindrical halves 47 and 49 which are separated by and are connected to each other by a rubber layer 51 as shown in FIGS. 8 and 9. The end parts 53 and 55 (FIG. 4) of pin 46 has curved surfaces 57 and 59 to mate with adjacent curved surfaces on the legs 31 and 38 at the entrances of holes 42 and 44 thereof. Thus, when pin 46 is in the holes 40, 42 and 44 as shown in FIG. 4, the halves 47 and 49 of the pin are compressed toward each other so that the rubber layer 51 provides a bias force exerting a force outwardly on the halves 47 and 49 so as to releasably secure the adapter 16 to the corresponding lip segment 15.

Another type of pin is shown in FIG. 6 and is broadly denoted by the numeral **46*a*. Pin 46*a* includes a pair of wedge-shaped members 47*a* and 49*a* which are received within aligned holes 40, 42 and 44, the wedge shape being sufficient to bias the members 47*a* and 49*a* in outward directions with respect to the aligned holes to thereby releasably couple the adapter unit 16 with a corresponding lip segment 15**.

In use, lip 14 is rigidly coupled to bucket 12 in any suitable manner, such as by welding or the like. The lip 14 although of one piece, can be considered to have a plurality of lip segments 15 which are integral with each other and are positioned along the length of the lip. Individual adapters 16 are coupled to corresponding lip segments 15 so that teeth 18 can be coupled to the respective adapters and extend outwardly therefrom as shown in FIG. 1 for excavation purposes.

When it is desired to couple an adapter 16 to a lip segment 15, legs 31 and 38 of the adapter 16 are moved into respective pockets 30 and 34 so that the inner ends of legs 31 and 38 are received in the pockets as shown in FIG. 4. When this occurs, holes 40, 42 and 44 are aligned with each other, and a pin 46 or a pin **46*a* can be inserted into the aligned holes to effectively couple the adapter to the lip segment 15**.

Adapter 16 has a pair of relatively thick shoulder shrouds 60 at the sides thereof as shown in FIG. 3. These shoulder shrouds protect the adjacent outer surfaces 20 and 22 (FIG. 2) of the corresponding lip segment 15. The outer end 19 of each segment 15 is received in a hollow space 61 (FIG. 5) of the corresponding adapter 16 to further protect the segment from wear.

The design of the lip segments 15 and adapters 16 allows the weight of the lip and adapter combination to be minimized. Moreover, the use of the pockets 30 and 34 provide a connection which is effectively as strong as a welded connection and allows for effective replacement of adapters 16 in a minimum of time. The shape of each adapter 16 is streamlined to keep the weight down and minimizing wear of the lip segments and adapters while allowing for quick interchangeability as the tooth protects the adapter 16. The lip and adapter design also allows for a greater volume of material to be scooped up in a bucket for each pass of the bucket through the ore to be excavated. This feature results in an excavation system of increased efficiency.

An alternate means of coupling the adapter to the lip segment is shown in FIG. 6A. The angled end 65 of the upper leg 69 has parallel upper and lower surfaces 73 and 75 and has a hole 77 that is aligned with a pair of spaced, aligned holes 79 and 81 in the lip segment to accept a wedge block 66 and the wedge key 67. The wedge block 66 has shear pins 68 to hold this block 66 in the correct position to accept the wedge key 67. As the wedge key 67 is driven down, the tail part 69 of the long leg of the adapter is bent or is yieldable to lock the wedge key in place. To remove adapter 70 from lip segment 71, wedge block 66 is drive downwardly shearing pins 68 and thereby allowing wedge block 66 to drop out. This action causes the releasing of wedge key 67, allowing adapter 70 to be removed from the lip segment 71.

A short leg 80 is on the lower part of the adapter and is receivable in a pocket 82 of the lip segment.

I claim:

1. In an ore excavation bucket:

a lip having a plurality of segments;

an adapter for each lip segment, respectively, each adapter having a pair of spaced legs, each leg having an inner end, each lip segment being receivable in the space between the legs of the corresponding adapter when the adapter is in an operative position on the lip segment;

means defining a pocket on each segment for receiving the end of each leg of the corresponding adapter, respectively, when the adapter is in said operative position;

a pin for coupling each adapter to the corresponding lip segment; and means on the adapter for mounting an excavation tooth thereon.

2. In a bucket as set forth in claim 1, wherein one of the legs of each adapter is longer than the other leg.

3. In a bucket as set forth in claim 1, wherein each adapter has an upper leg and a lower leg, the upper leg of each adapter being longer than the lower leg.

4. In a bucket as set forth in claim 1, wherein said pin is a spring pin.

5. In a bucket as set forth in claim 1, wherein said pin means includes a wedge-shaped pin.

6. In a bucket as set forth in claim 1, wherein said pin means includes a wedge block and a wedge key.

7. In a bucket as set forth in claim 1, wherein the lip segment has a pair of holes therethrough near the pocket for receiving one of the legs, said one leg having a hole alignable with the pair of holes of the lip segment when said one leg is in the corresponding pocket, said pin means including a wedge block and a wedge key in said aligned holes.

8. In a bucket as set forth in claim 7, wherein the wedge block has a shear pin to hold the block in a position to accept the wedge key.

9. In a bucket as set forth in claim 1, wherein the legs of each adapter have aligned holes therein, each lip segment having a hole aligned with the holes of the legs of the corresponding adapter when the inner ends of the legs of the adapter are received within respective pockets of the lip segment.

10. In a bucket as set forth in claim 1, wherein each adapter has a pair of shoulder shrouds and a hollow space for receiving the outer end of the corresponding lip segment with the shoulder shrouds of the adapter being in covering relationship to the outer end of the lip segment.

11. In a bucket as set forth in claim 1, wherein one of the legs has an inner end extending at an angle relative to the major portion of said one leg, said inner end extending into the corresponding pocket and below the adapter surface of the lip segment.

12. In a bucket as set forth in claim 1, wherein each segment has an upper surface and a lower surface, said pockets being on respective surfaces of the lip segment, the upper pocket extending below the upper surface, one of the legs of each adapter having an inner end extending at an angle relative to the major portion of said one leg, said end extending into the upper pocket and below the upper surface of the corresponding lip segment.

13. In a bucket as set forth in claim 12, wherein the end of said one leg extends at an angle in the range of 10° to 30° relative to the length of said one leg.

14. In a bucket as set forth in claim 12, wherein the other leg extends at an angle relative to the corresponding adapter, the angle being in the range of 10° to 30° relative to the length of the other leg.

15. In a bucket as set forth in claim 12, wherein said one leg is the upper leg of the adapter.

16. In an ore excavation bucket having a lip with a plurality of segments with each segment having an upper pocket and a lower pocket:

an adapter for one of the lip segments, the adapter having a pair of spaced legs, each leg having an inner end, one end of the lip segment adapted to be received in the space between the legs of the adapter when the adapter is in an operative position on the lip segment, the inner ends of the legs being receivable within respective pockets of the lip segment, the legs adapted to be coupled by pin means to the lip segment; and means on the adapter for mounting an excavation tooth thereon.

17. In a bucket as set forth in claim 16, wherein one of the legs of the adapter is the upper leg and the other leg is the lower leg, one of the legs being longer than the other leg.

18. In a bucket as set forth in claim 17, wherein the upper leg is longer than the lower leg.

19. In a bucket as set forth in claim 17, wherein the inner end of the upper leg extends at an angle relative to the major portion of the one leg, said inner end of the upper leg adapted to extend into the corresponding pocket of a lip segment below the adjacent surface of the lip segment.

20. In a bucket as set forth in claim 17, wherein the end of the upper leg extends at an angle in the range of 10° to 30° relative to the length of the upper leg.

21. In a bucket as set forth in claim 17, wherein the other leg extends at an angle relative to the corresponding adapter, the angle being in the range of 10° to 30° relative to the length of a lip segment.

22. In a bucket as set forth in claim 17, wherein said pin means includes a wedge block and a wedge key.

23. In a bucket as set forth in claim 17, wherein the lip segment has a pair of holes therethrough near the pocket for receiving one of the legs, said one leg having a hole alignable with the pair of holes of the lip segment when said one leg is in the corresponding pocket, said pin means including a wedge block and a wedge key in said aligned holes.

24. In a bucket as set forth in claim 23, wherein the wedge block has a shear pin to hold the block in a position to accept the wedge key.

* * * * *